United States Patent [19]

Moses

[11] 4,420,898

[45] Dec. 20, 1983

[54] FLAT EMERGENCY EXIT SIGN UTILIZING AN ELECTRO-ILLUMINESCENT LAMP

[76] Inventor: John R. Moses, 3440 Chesapeake Walk, Annapolis, Md. 21403

[21] Appl. No.: 353,390

[22] Filed: Mar. 1, 1982

[51] Int. Cl.[3] ..... G09F 13/04

[52] U.S. Cl. ..... 40/570; 40/544

[58] Field of Search ..... 40/544, 570

[56] References Cited

U.S. PATENT DOCUMENTS

| | | | |
|---|---|---|---|
| 3,038,271 | 6/1962 | MacHutchin et al. | 40/544 |
| 3,083,317 | 3/1963 | Fish et al. | 40/544 |
| 3,404,474 | 10/1968 | Johnson | 40/544 |
| 3,562,942 | 2/1971 | Mabrey | 40/570 |
| 3,680,237 | 8/1972 | Finnerty, Sr. | 40/544 |
| 3,780,462 | 12/1973 | Pregel et al. | 40/570 |

*Primary Examiner*—John J. Wilson

*Attorney, Agent, or Firm*—Quaintance & Murphy

[57] ABSTRACT

An "EXIT" sign utilizes a flat fluorescent lamp for illuminating the word "EXIT" through a stencil. The sign also includes a phosphorescent material which cooperates with the stencil to display the word "EXIT" when power to the lamp is cut.

3 Claims, 4 Drawing Figures

FLAT EMERGENCY EXIT SIGN UTILIZING AN ELECTRO-ILLUMINESCENT LAMP

BACKGROUND OF THE INVENTION

Almost all public buildings are required to have signs identifying emergency exits. These signs are generally rectangles and are perhaps 12 inches long and eight inches high. The dimensions may vary depending on the code or standard governing the size of the signs.

Most of these signs are illuminated by incandescent lamps. In order to illuminate the entire sign, two 20-watt lamps are usually required. Most fire codes require that the signs be lit continuously while the building is occupied. Since many public buildings have numerous exits, a single building may have lieterally hundreds of signs consuming thousands of kilowatts of electricity per year. In addition, the signs generate heat which must be removed during the air conditioning season. Since the signs are located near ceilings, the heat input during the heating season is minimized because the heat input therefrom is conducted and convected along the floors to the exterior walls of the building. Moreover, at least one of the emergency exit lightbulbs can be expected to burn out during the course of the year. When a building has hundreds of emergency exit signs, the cost of replacing these bulbs can be quite high. When one consdiers the cost of the bulbs themselves, they are expensive (as is the cost of the labor required to replace the bulb). One inventor who has studied this problem, Emanuel L. Logan, Jr., estimates that each emergency exit sign costs between $70 and $120 per year to operate and maintain.

In view of these considerations, a new type of emergency exit sign which is inexpensive to operate and maintain is needed.

SUMMARY OF THE INVENTION

In view of the aforementioned considerations, it is a feature of the instant invention to provide a new and improved emergency exit sign which is inexpensive to purchase, operate and maintain and which has a relatively long life.

In view of this feature, the instant invention contemplates an emergency exit sign which includes a flat electro-illuminescent panel and a stencil defining the word "EXIT" disposed over the panel. The exit sign further includes a phosphorescent material which is energized in part by the flat lamp and remains lit even when the flat lamp is extinguished, whereby the sign is visible when power to the flat lamp is cut.

DESCRIPTION OF THE PREFERRED EMBODIMENT

Figure 1:
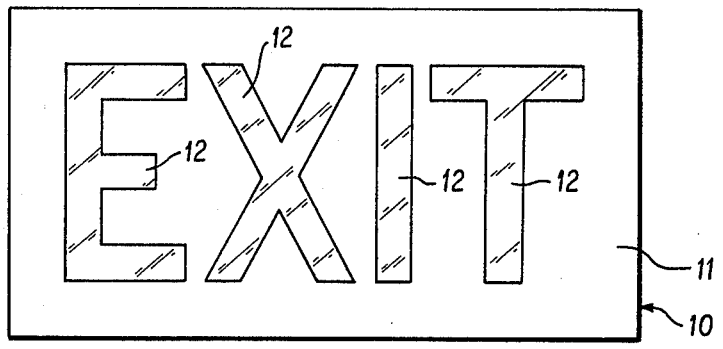
FIG. 1 is a front view of an emergency exit sign in accordance with the principles of the instant invention with the word "EXIT displayed."

Referring now to the drawings, FIG. 1 shows an exit sign, designated generally by the numeral 10, wherein the exit sign is approximately eight inches high and 12 inches in length. The word "EXIT" is defined by a stencil 11 that has cutouts 12 therein forming the word "EXIT". The word "EXIT" is illuminated by a flat lamp, designed by the numeral 13 (See FIGS. 2, 3 and 4) which shines through the openings 12 in the stencil 11.

The flat lamp 13 keeps the exit sign 10 lit as long as there is power to the lamp. When power to the lamp 13 is cut, the exit sign in accordance with the instant invention remains visible because the word "EXIT" is still defined by phosphorescent material. In accordance with one embodiment of the invention, the stencil 11 may be coated with a phosphorescent material which glows in the dark due to light energy absorbed in the phosphorescent material when the lamp was lit.

In accordance with another embodiment of the invention, the exit sign 10 remains visible in the dark because the phosphorescent material is dispersed in the phosphers which are used in the lamp 13.

Figure 2:
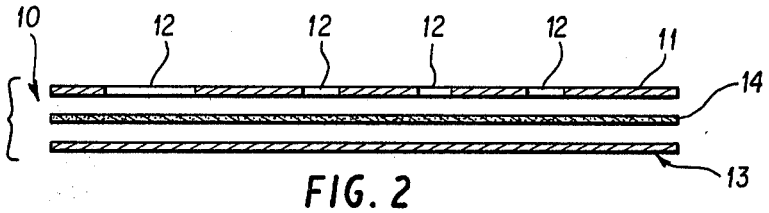
FIG. 2 is an exploded view showing the lamination which forms the exit sign of FIG. 1.

In accordance with the embodiment of the invention shown in FIG. 2, the word "EXIT" remains visible even though power to the lamp 13 is interrupted because a vinyl sheet 14 encapsulating or impregnated with phosphorescent material 14 is sandwiched between the stencil 12 and flat lamp 13. In the embodiment of FIG. 2, the phosphorescent material may be a one which is energized by both light in the room and by the lamp 13 disposed behind the sheet 14. Even though the sheet 14 is not transparent but is merely translucent, it has been found that light in the flat lamp 13 is transmitted through the phosphorescent material in the sheet 14 and word "EXIT" remains as visible as it is when the insert is not present.

Figure 3:
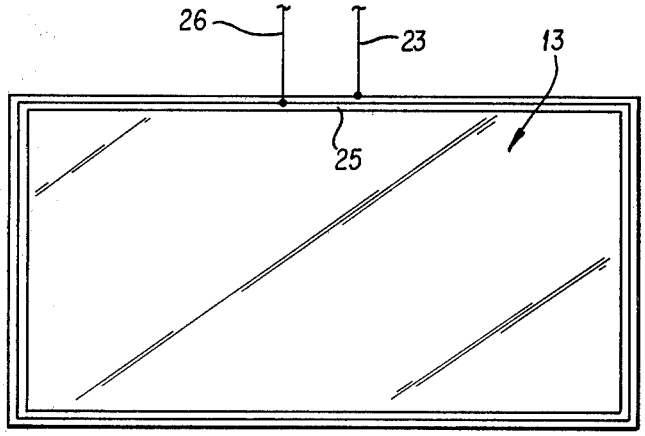
FIG. 3 is a planar view of an EL lamp used with the exit sign of FIGS. 1 and 2.
Figure 4:
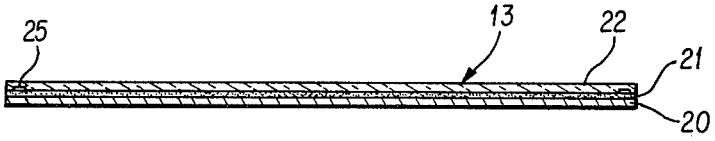
FIG. 4 is a section taken along Line 4-4 of FIG. 3.

A preferred flat lamp in shown in FIGS. 3 and 4 wherein a steel substrate 20 has a layer of phosphors 21 thereon sealed by a layer of glass 22. The steel plate 20 forms a first electrode and is attached to a lead 23. A second electrode 25 is formed by a ribbon metal which is laid on top of the phosphors 21 in space relation to the metal plate 20. The conductor 25 is connected to a lead 26. The leads 26 and 23 are connected to regular AC line current. When current is applied, the lamp 13 glows. This type of lamp is manufactured by the Potter Electronics Company of Charlotte, N.C. and was developed and invented by a David Emitt.

Another type of lamp that may be utilized uses a flexible substrate of plastic material which has a layer of foil on it. The entire lamp is encapsulated in a clear plastic resin. The flexible lamp tends to the more expensive and may not have a life as long as the aforedescribed rigid lamp shown in FIGS. 3 and 4.

A lamp configured in accordance with the aforedescribed disclosure is expected to have a life of five to seven years and consumes perhaps one-hundredth of the electrical power consumed by emergency exit signs which are now in use. In accordance with the calculations of Emanuel L. Logan, Jr., such a sign will cost approxiamtely 70 cents per year to maintain and operate instead of $70–$120. Moreover, such sign will not burn out for a number of years, perhaps five years. In addition, the sign in accordance with the instant invention is inexpensive to manufacture, and install, and is therefore competitive in price with signs currently on the market.

What is claimed is:

1. An emergency exit sign comprising:

a stencil with the term "EXIT" formed by openings therethrough;

a single, flat electro-luminescent lamp disposed behind the stencil to provide illumination through the stencil; the electro-luminescent lamp being opaque with respect to one side and being of unitary construction; the lamp comprising a lamination including a steel substrate, a layer of phosphors on the steel substrate and a layer of glass over the phosphors to seal the phosphors between the layer of glass and substrate, the lamination further including an electrode spaced from the substrate and connected to a first lead and a second lead connected to the substrate wherein the lamp glows when AC line current is applied to the leads, and a layer of translucent phosphorescent material juxtaposed with the lamp and aligned with the opening through the stencil, the phosphorescent material being energized by the lamp and continuing to glow when power to the lamp is cut;

whereby, a flat, inexpensive exit sign is provided which has improved longetivity while consuming minimal electrical power.

2. The emergency exit sign of claim 1 wherein the phosphorescent material is in a translucent sheet disposed between the stencil and lamp.

3. The emergency exist sign of claim 1 wherein the phosphorescent material is disposed with the phosphors used in the lamp.

* * * * *